US010526811B2

(12) United States Patent
Carter

(10) Patent No.: US 10,526,811 B2
(45) Date of Patent: Jan. 7, 2020

(54) METHOD AND APPARATUS FOR DISPLAYING INFORMATION WITHIN AN INNER SIDE OF A CANOPY

(71) Applicant: Mark C. Carter, Norco, CA (US)

(72) Inventor: Mark C. Carter, Norco, CA (US)

(73) Assignee: International E-Z UP, Inc., Norco, CA (US)

( * ) Notice: Subject to any disclaimer, the term of this patent is extended or adjusted under 35 U.S.C. 154(b) by 0 days.

(21) Appl. No.: 16/173,278

(22) Filed: Oct. 29, 2018

(65) Prior Publication Data

US 2019/0078349 A1 Mar. 14, 2019

Related U.S. Application Data

(63) Continuation-in-part of application No. 15/885,796, filed on Jan. 31, 2018.

(60) Provisional application No. 62/579,052, filed on Oct. 30, 2017, provisional application No. 62/453,478, filed on Feb. 1, 2017.

(51) Int. Cl.

| | |
|---|---|
| ***E04H 15/54*** | (2006.01) |
| ***E04H 15/40*** | (2006.01) |
| ***E04H 15/46*** | (2006.01) |
| ***E04H 15/50*** | (2006.01) |
| ***G09F 15/00*** | (2006.01) |
| ***E04H 15/32*** | (2006.01) |
| *E04H 15/64* | (2006.01) |
| *E04H 15/60* | (2006.01) |

(52) U.S. Cl.

CPC ..... *E04H 15/54* (2013.01); *E04H 15/32* (2013.01); *E04H 15/405* (2013.01); *E04H 15/46* (2013.01); *E04H 15/50* (2013.01); *G09F 15/0025* (2013.01); *G09F 15/0062* (2013.01); *E04H 15/60* (2013.01); *E04H 15/646* (2013.01)

(58) Field of Classification Search

CPC ..... E04H 15/54; E04H 15/64; G09F 15/0025
USPC ..... 40/604, 606.17
See application file for complete search history.

(56) References Cited

U.S. PATENT DOCUMENTS

| | | | | |
|---|---|---|---|---|
| 965,097 | A * | 7/1910 | Fisher | G09F 15/0025 40/603 |
| 3,394,720 | A * | 7/1968 | Moss | E04H 15/003 135/125 |
| 3,792,678 | A * | 2/1974 | Rowland | E01F 9/688 116/63 P |
| 4,906,503 | A * | 3/1990 | De La Cruz | G09F 7/18 116/173 |

(Continued)

FOREIGN PATENT DOCUMENTS

DE 202010015106 12/2011

OTHER PUBLICATIONS

International Search Report dated Jan. 7, 2019 for PCT Application No. PCT/US2018/58205.

*Primary Examiner* — Noah Chandler Hawk
(74) *Attorney, Agent, or Firm* — Seyfarth Shaw LLP; Puya Partow-Navid

(57) ABSTRACT

A method of providing information on an interior of a shelter via a sail is presented. The method includes attaching a first fastener of the sail to a peak bracket of the shelter and attaching a second fastener of the sail to a leg bracket of the shelter. The method also includes attaching a third fastener of the sail to a first joint of the shelter and attaching a fourth fastener of the sail to a second joint of the shelter.

20 Claims, 16 Drawing Sheets

(56) References Cited

U.S. PATENT DOCUMENTS

| | | | | |
|---|---|---|---|---|
| 5,778,613 | A * | 7/1998 | Thomson | E04H 15/64 135/115 |
| 6,866,053 | B2 | 3/2005 | You | |
| 6,920,889 | B2 | 7/2005 | Carter | |
| 6,997,198 | B1 * | 2/2006 | Holtkamp | E04H 15/16 135/115 |
| 7,779,849 | B2 | 8/2010 | Labarbera | |
| 9,297,178 | B2 * | 3/2016 | Dalo | E04H 15/26 |
| 9,593,507 | B1 * | 3/2017 | Aicher, Jr. | E04H 15/003 |
| 2006/0096631 | A1 | 5/2006 | Mallookis | |
| 2011/0162244 | A1 * | 7/2011 | Reynolds | G09F 15/0025 40/604 |
| 2012/0273016 | A1 | 11/2012 | Pandak | |
| 2016/0115699 | A1 * | 4/2016 | Pelillo | E04H 1/1205 52/63 |
| 2017/0089092 | A1 | 3/2017 | Krenzel | |

* cited by examiner

METHOD AND APPARATUS FOR DISPLAYING INFORMATION WITHIN AN INNER SIDE OF A CANOPY

CROSS-REFERENCE TO RELATED APPLICATION

The present application is a continuation-in-part of U.S. patent application Ser. No. 15/885,796, filed on Jan. 31, 2018, and titled "MULTI-POINT FIXED ATTACHMENT SYSTEM," which claims the benefit of U.S. Provisional Patent Application No. 62/579,052, filed on Oct. 30, 2017, and titled "METHOD AND APPARATUS FOR DISPLAYING INFORMATION WITHIN AN INNER SIDE OF A CANOPY," and U.S. Provisional Patent Application No. 62/453,478, filed on Feb. 1, 2017, and titled "MULTI-POINT FIXED ATTACHMENT SYSTEM," the disclosures of which are expressly incorporated by reference herein in their entireties.

BACKGROUND

Field

Certain aspects of the present disclosure generally relate to folding, collapsible structures and, more particularly, to a collapsible, field shelter structure with an attachment system for affixing information sails within the inner portion of a canopy.

Background

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework is described in U.S. Pat. No. 4,607,656. The legs of that shelter are capable of telescoping to approximately twice their stowed length, and the framework of X-shaped truss pairs is capable of horizontal extension between the legs to support a canopy. The framework can be constructed of lightweight material, and the telescoping legs can be extended to raise the framework of the shelter.

In some cases, walls, such as sidewalls and/or interior walls, banners, and other material may be attached to a frame of the shelter. Conventional systems attach walls and banners to an exterior of the shelter for providing information, such as a menu, advertising, etc. Although the exterior of the shelter is visible to those that are outside of the shelter, the exterior walls and banners are not visible from within a shelter.

It is desirable to provide a method and structure for providing information, such as advertisements, to those that are within a shelter.

SUMMARY

In one aspect of the present disclosure, a sail is disclosed. The sail includes a first fastener for attaching the sail to a peak bracket of a shelter. The sail also includes a second fastener for attaching the sail to a leg bracket of the shelter. The sail still further includes a third fastener for fastening the sail to a first joint of the shelter. The sail still yet further includes a fourth fastener for attaching the sail to a second joint of the shelter.

In another aspect of the present disclosure, a method of providing information on an interior of a shelter via a sail is disclosed. The method includes attaching a first fastener of the sail to a peak bracket of the shelter. The method also includes attaching a second fastener of the sail to a leg bracket of the shelter. The method further includes attaching a third fastener of the sail to a first joint of the shelter. The method still further includes attaching a fourth fastener of the sail to a second joint of the shelter.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The features, nature, and advantages of the present disclosure will become more apparent from the detailed description set forth below when taken in conjunction with the drawings in which like reference characters identify correspondingly throughout.

DETAILED DESCRIPTION

Figure 1A:
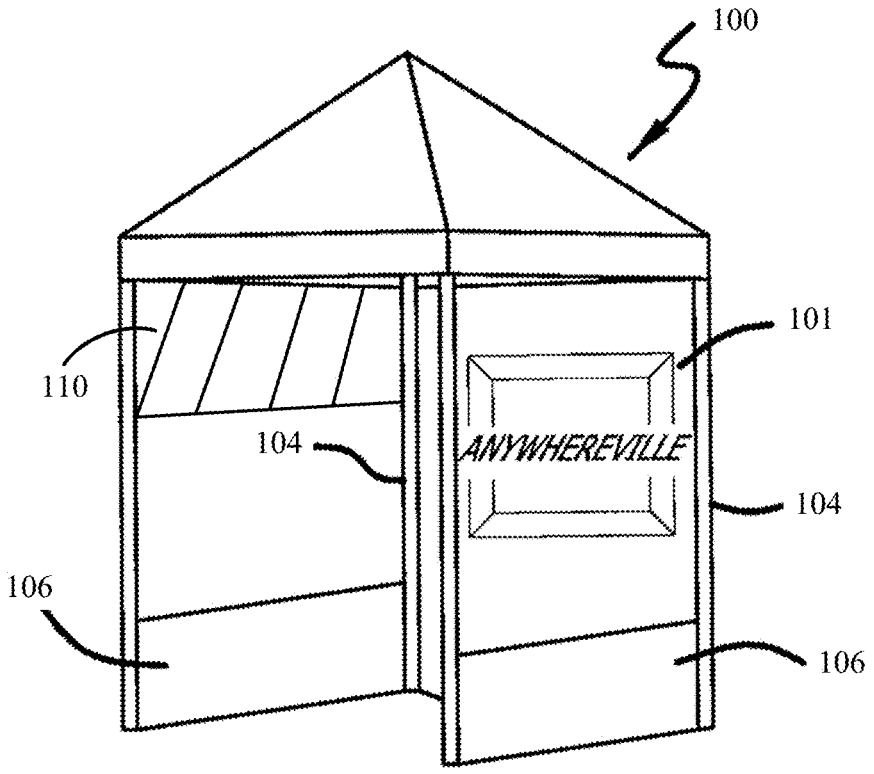
FIGS. 1A and 1B illustrate examples of shelters with various structures attached to the frames.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Based on the teachings, one skilled in the art should appreciate that the scope of the disclosure is intended to cover any aspect of the disclosure, whether implemented independently of or combined with any other aspect of the disclosure. For example, an apparatus may be implemented or a method may be practiced using any number of the aspects set forth. In addition, the scope of the disclosure is intended to cover such an apparatus or method practiced using other structure, functionality, or structure and functionality in addition to or other than the various aspects of the disclosure set forth. It should be understood that any aspect of the disclosure disclosed may be embodied by one or more elements of a claim.

The word "exemplary" is used herein to mean "serving as an example, instance, or illustration." Any aspect described herein as "exemplary" is not necessarily to be construed as preferred or advantageous over other aspects.

Although particular aspects are described herein, many variations and permutations of these aspects fall within the scope of the disclosure. Although some benefits and advantages of the preferred aspects are mentioned, the scope of the disclosure is not intended to be limited to particular benefits, uses or objectives. Rather, aspects of the disclosure are intended to be broadly applicable to different technologies, system configurations, networks and protocols, some of which are illustrated by way of example in the figures and in the following description of the preferred aspects. The detailed description and drawings are merely illustrative of the disclosure, rather than limiting the scope of the disclosure being defined by the appended claims and equivalents thereof.

A foldable (e.g., collapsible) shelter may be used in various scenarios. For example, the foldable shelter may be used as a display booth, a shelter, an exhibit, a storefront, etc. The foldable shelter may be referred to as a shelter. The shelter may include three or more sides. The sides may be of different sizes (e.g., lengths) or the same size.

Multiple outer truss links may form the border of the shelter. Two outer truss links may form an outer truss link pair. The outer truss links of each outer truss link pair may be pivotally connected to each other at a joint, such as in a scissor configuration. Each side may include one or more outer truss link pairs. One or more legs may be attached to each outer truss link pair. The legs and the outer truss link pairs may support a roof structure. The roof structure may be further supported by peak truss links and/or inner truss links.

Banners, sidewalls, and other structures may be attached to the frame of a shelter. In conventional shelters, the various structures are strapped to the frame. For example, a sideskirt may be strapped via string, rope, a Velcro™ strap, or other fastening structure. The conventional fasteners do not keep the structures secure and taut. For example, in conventional shelters, a sidewall or side skirt may sag or may disconnect from the shelter in areas of high wind.

Figure 1B:
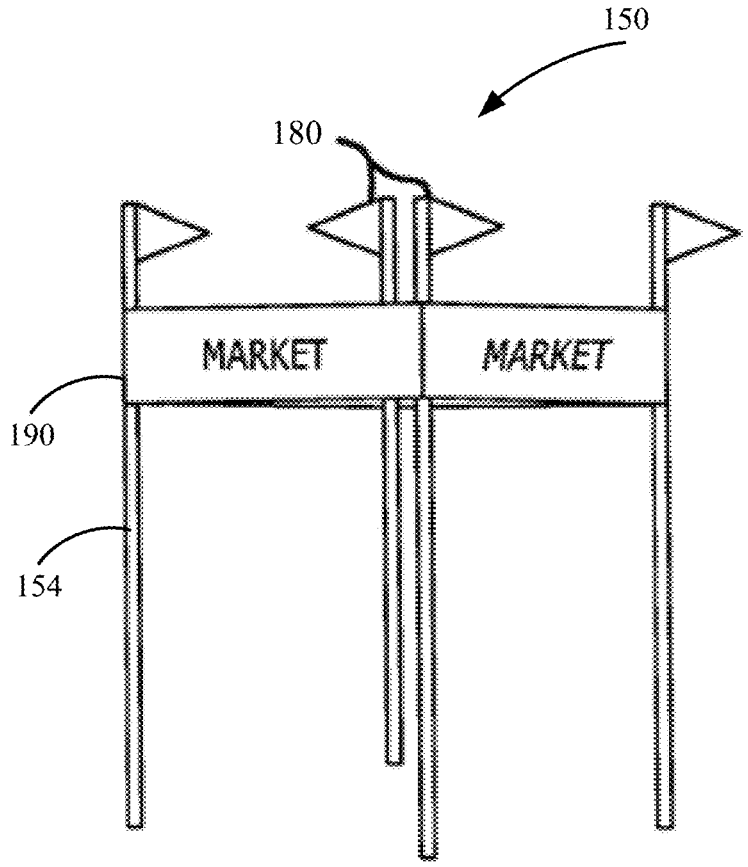

FIG. 1A illustrates an example of a conventional shelter 100 with sidewalls 101 and skirts 106 attached to the legs 104. The sidewalls 101 and side skirts 106 may be formed of a fabric material such as a polyester fabric. As previously discussed, in conventional systems, the sidewalls 101 and side skirts 106 may attach directly to the legs 104 or perimeter truss via a connection, such as a fastener attached to a strap. The connections are neither secure nor taut. Therefore, the sidewalls 101 and side skirts 106 are prone to sagging or disconnecting from the legs 104. Additionally, or alternatively, banners, flags, and/or other types of dressings may be mounted to the legs and/or frame. As an example, half walls 110 may also be mounted to the legs 104. FIG. 1B illustrates another example of a booth structure 150 with flags 180 and banners 190 may be mounted to the legs 154.

As shown in FIGS. 1A and 1B, the sidewalls 101, side skirts 106, flags 180, and banners 190 are visible from the exterior of the shelter 100. The sidewalls 101, side skirts 106, flags 180, and banners 190 may have information printed on both sides. Still, there is unused space on the interior of a shelter's dome (e.g., ceiling). Still, the space on the interior of the shelter's dome may also be used to provide information (e.g., advertisements). Conventional fastening systems do not provide a system for attaching structures, such as flags and banners to an interior of the shelter.

It is desirable to provide a system to improve a customer's ability to attach various structures to a shelter. Aspects of the present disclosure are directed to a multi-point attachment system that provides multiple points in a shelter for securely fastening a structure, such as a flag, banner, sideskirt, tent, etc., to the shelter's frame. According to aspects of the present disclosure, the multi-point attachment system provides a solution for a customer to attach different structures to the interior and/or exterior of the frame.

In one configuration, the multi-point attachment system provides attachment points at a center of a shelter as well as corners of the shelter. Of course, aspects of the present disclosure are not limited to providing attachment points at the center and all corners, as various configurations are contemplated based on a customer's need.

Some shelters may have a roof structure that is elevated with a telescoping peak beam. The peak beam may be connected to a bracket (e.g., center bracket) with multiple sockets. The sockets may receive one end of the peak beam as well as ends of truss links. In one configuration, one or more attachment points are provided at the center bracket.

Figure 2:
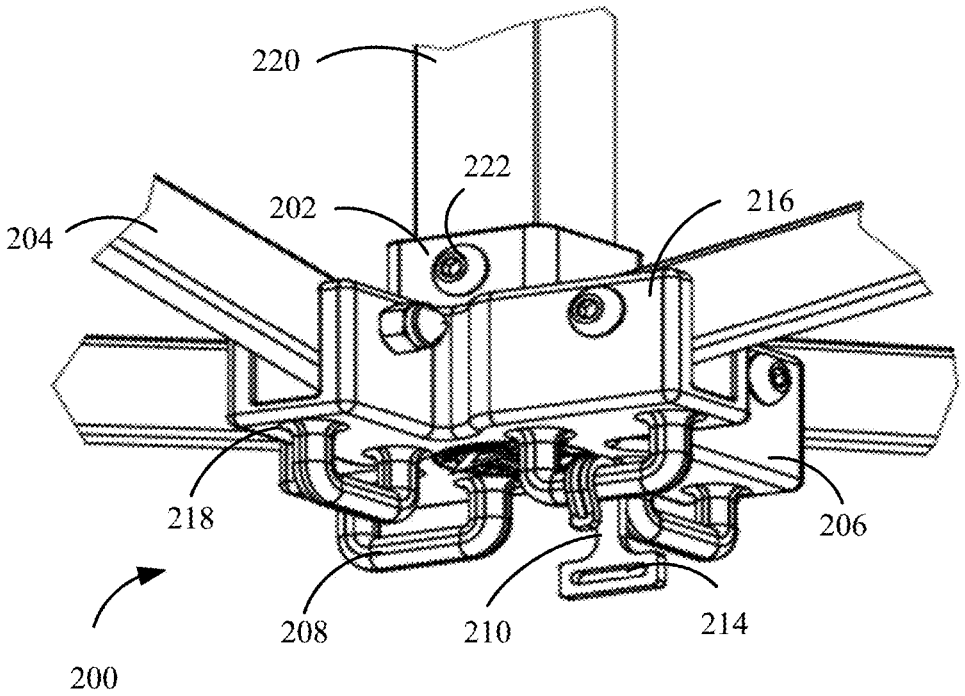
FIG. 2 illustrates an example of an element of a multi-point fixed attachment system according to aspects of the present disclosure.

FIG. 2 illustrates an example of a center bracket 200 according to aspects of the present disclosure. As shown in FIG. 2, an end of a peak beam 220 is coupled to a center socket 202 of the center bracket 200. The end of the peak beam 220 may be secured to the center socket 202 via a bolt 222 or other type of fastener. The center socket 202 may be a square-shaped socket for receiving an end of the peak beam 220. Of course, the center socket 202 may have other shapes, such as a circle or other parallelogram, based on a shape of the peak beam 220.

Additionally, the center bracket 200 includes multiple side sockets 206 extending from the body of the center bracket 200. In one configuration, each socket is at substantially right angles from an adjacent socket 206. FIG. 2 illustrates the center bracket 200 with four sockets 206. Aspects of the present disclosure are not limited to the center bracket 200 with four sockets 206 as more or fewer sockets 206 are contemplated.

Each socket 206 is coupled to a truss link 204 via a bolt 222 or other type of fastener. The truss links 204 may pivot within the respective sockets 206. In one configuration, to allow a truss link 204 to pivot when coupled to a socket 206, the sockets 206 include three sides (e.g., two arms 216 and a base 218). Furthermore, as shown in FIG. 2, a handle 208 is attached to each socket 206. In one configuration, the handle 208 is u-shaped and is attached to an outer side of the base 218. The inner side of the base 218 refers to a side that is adjacent to a truss link 204. Aspects of the present disclosure are not limited to the handles 208 having a u-shape and are contemplated for other designs that allow for a fastener 210, or other apparatus, to attach to the handle. Aspects of the present disclosure are not limited to the handles 208 being attached to the outer side of the base 218 and are contemplated for the handles 208 being attached to other portions of the center bracket 200.

As shown in FIG. 2, the fastener 210 is attached to the handle 208. As an example, the fastener 210 may be a hook, clasp, clip, or other type of structure to be coupled with the handle 208 of the socket 206. An opening 214 of the fastener 210 may receive a connector from a dressing, such as a wall, sidewall, skirt, flag, and/or banner. That is, the opening 214 is specified to receive a strap or material connected to a dressing, such as a wall, sidewall, skirt, flag, and/or banner.

Figure 3:
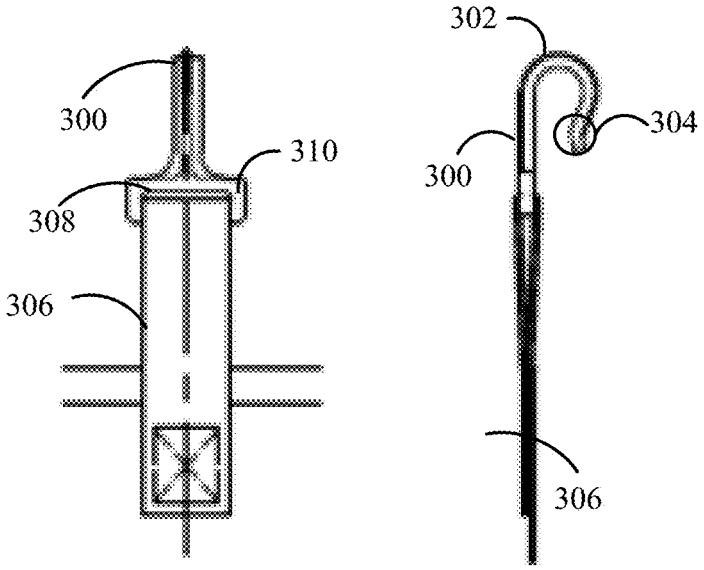
FIG. 3 illustrates an example of a connector for a multi-point fixed attachment system according to aspects of the present disclosure.

FIG. 3 illustrates an example of a fastener 300 according to aspects of the present disclosure. In one configuration, the fastener 300 is provided for attaching a dressing or structure to an attachment point, such as a handle of a bracket. As shown in FIG. 3, the fastener 300 includes a hook portion 302 that curves at a top of the fastener 300. A portion of the fastener 300 extends outward at the nose of the hook portion 302 to form a v-shaped end 304 for the fastener 300. As previously discussed, the fastener 300 is adapted to clip to a handle of a bracket. The v-shaped end 304 improves the retainment of the fastener 300 with a handle (e.g., attachment) of a multi-point attachment system.

Furthermore, as shown in FIG. 3, in one configuration, a strap 306 is extended through the opening 308 of the fastener 300. The opening 308 may be defined in a rectangular shaped end 310 of the fastener 300. Of course, aspects of the present disclosure are not limited to the fastener 300 having a rectangular shaped end 310 as other shapes are contemplated. The strap 306 may be sewn (e.g., connected) to a material of a dressing, such as a sidewall or skirt. Aspects of the present disclosure are also contemplated for the strap 306 to be connected to material of other structures, such as a tent, a flag, an inner wall extending along the roof of the canopy, or any other type of dressing (e.g., structure/fabric/material). In one configuration, the length of the strap 306 is adjustable.

Figure 4A:
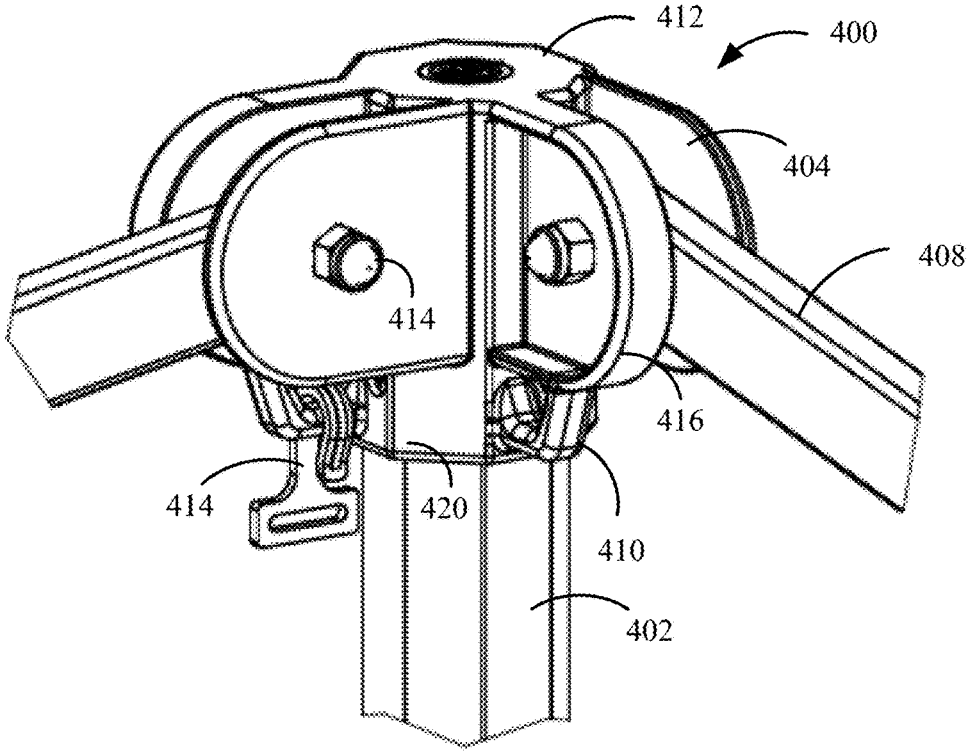
FIGS. 4A and 4B illustrate examples of elements of a multi-point fixed attachment system according to aspects of the present disclosure.
Figure 4B:
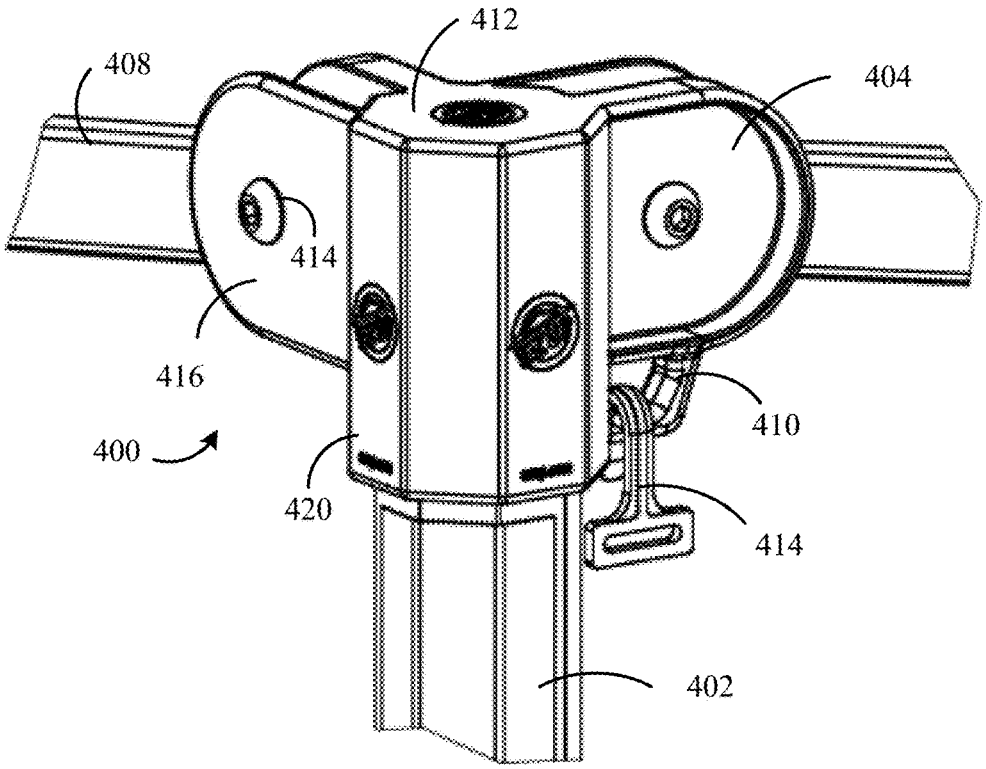

As previously discussed, a center bracket may include attachment points (e.g., handles) for a multi-point attachment center. In one configuration, attachment points are defined on leg brackets of a shelter. The attachment points on the leg brackets may be provided alternate to or in addition to the attachment points of the center bracket. FIGS. 4A and 4B illustrate examples of different views of a leg bracket 400 according to aspects of the present disclosure. FIG. 4A illustrates a first view (e.g., front view) of the leg bracket 400 and FIG. 4B illustrates a second view (e.g., back view) of the leg bracket 400. The second view is opposite of the first view. As shown in FIGS. 4A and 4B, the leg bracket 400 is connected to a leg 402 of the collapsible frame. That is, a socket 420 of the leg bracket 400 receives an end of the leg 402. The leg 402 may be attached to the socket 420 via a bolt or other attachment (not shown).

The leg bracket 400 includes multiple sockets 404 extending outward from a body 412 of the leg bracket 400. Each socket 404 may be at substantially right angle from an adjacent socket 404. Aspects of the present disclosure are not limited to two sockets 404 as shown in FIGS. 4A and 4B; the leg bracket 400 may have one or more sockets 404. For example, in one configuration, the leg bracket 400 includes only one socket 404 extending outward from a body 412 of the leg bracket 400.

An end of a link member 408 is received in each socket 404 of the leg bracket 400. The end of the link member 408 may be pivotally connected to the socket 404. Specifically, the end of the link member 408 may be attached to the socket via a bolt 414 or other attachment. The socket 404 of the leg bracket 400 includes two arms 416. As a roof and a floor are not defined for each socket 404 of the leg bracket 400, the link member 408 may pivot in an up or down direction.

In one configuration, a handle 410 (e.g., attachment point) is defined below each socket 404. A first end of the handle 410 may be attached to a bottom of one arm 416 of the socket 404 and a second end of the handle 410 may be attached to the body 412 of the leg bracket 400. Each handle 410 may be adaptable to receive a fastener 414. As previously discussed, the fastener 414 is adapted to be connected to material of a structure via a strap or other type of connector. The leg bracket 400 is not limited to receiving link members and may receive telescoping pole members or other structures of a frame of a shelter.

Figure 5A:
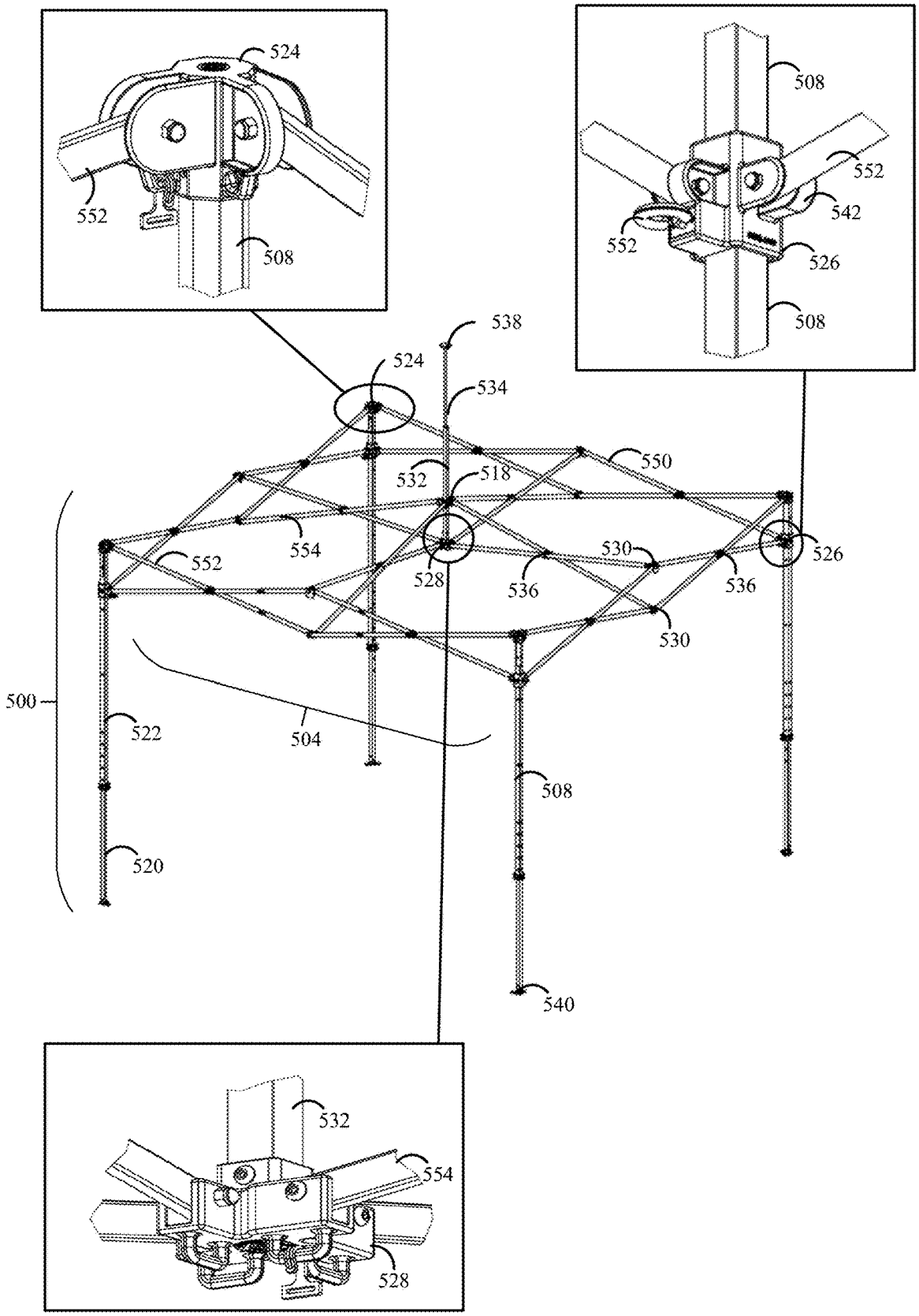
FIGS. 5A, 5B, 6A, 6B, and 7 illustrate examples of collapsible frames according to aspects of the present disclosure.

FIG. 5A illustrates an example of a frame of a shelter 500 in accordance with aspects of the present disclosure. The shelter 500 may be a modular folding shelter, such as a display booth. As shown in FIG. 5A, the frame has four sides 504 and four corners. Each side 504 may be substantially perpendicular to one or more adjacent sides 504. Of course, aspects of the present disclosure are not limited to a frame with four sides and four corners, as other configurations, such as three sides and three corners, are also contemplated. Additionally, adjacent sides 504 may be connected at an angle that is greater than or less than 90 degrees. The frame may be collapsible. In another configuration, the frame is fixed.

In one configuration, legs 508 are provided at each corner to erect the frame. The legs 508 may be telescoping (e.g., extendable). That is, each leg 508 may comprise a telescoping lower section 520 that extends from a hollow upper section 522. The telescoping lower section 520 may be slidably disposed within the telescoping lower section 520. Each telescoping lower section 520 has a foot 540 for engagement with the ground. Additionally, a perimeter truss framework 550 is connected to the legs 508 via brackets 524, 526 to stabilize and support the frame.

The perimeter truss frame 550 may include multiple outer truss links 552 and multiple inner truss links 554. Two outer truss links 552 may form an outer truss link pair. The outer truss links 552 of each outer truss link pair may be pivotally connected to each other at a cross-link joint 536, such as in a scissor configuration. In one configuration, a first end of each outer truss link 552 is pivotally connected to a leg 508 via either a leg bracket 524 or a sliding bracket 526. That is, a first end of one outer truss link 552 of each outer truss link pair may be pivotally connected to a socket of the leg bracket 524. Each socket of the leg bracket 524 may include an attachment point (e.g., handle) for receiving a fastener (see FIGS. 4A-B). The first end of another outer truss link 552 of each outer truss link pair may be pivotally connected to a socket of a sliding bracket 526, such that one outer truss link 552 of an outer truss link pair is slidably connected to a corresponding leg 508. A second end of each outer truss link 552 may be connected to a second end of another outer truss link 552 at an outer joint 530. The outer joint 530 may be a three-way joint.

As shown in FIG. 5A, two inner truss links 554 may be pivotally connected at a cross-link joint 536 to form an inner truss link pair. Two inner truss links 554 may be pivotally connected, such as in the scissor configuration. In one configuration, a first end of a first inner truss link 554 is pivotally connected to a second end of two outer truss links 552 at an outer joint 530. A second end of the first inner truss link 554 of each inner truss link pair is pivotally connected to a peak slider 518. Furthermore, a first end of a second inner truss link 554 of each inner truss link pair is pivotally connected to a second end of two outer truss links 552 at an outer joint 530. A second end of the second inner truss link 554 of each inner truss link pair is pivotally connected to a socket of the center bracket 528. Each socket of the center bracket 528 may include an attachment point (e.g., handle) for receiving a fastener (see FIG. 2).

The shelter 500 may include a peak beam 532 for supporting a roof structure (not shown), such as a canopy. The peak beam 532 may be attached to a center bracket 528. The peak slider 518 may also be slidably attached to the peak beam 532. In one configuration, a peak pole 534 is telescoping (e.g., extendable) from the peak beam 532. That is, the peak beam 532 may be hollow so that the peak pole 534 may extend upward from the peak beam 532. The peak pole 534 may be slidably disposed within the peak beam 532. Additionally, the peak pole 534 may include a top bracket 538 for engaging a roof structure, such as a canopy.

The top bracket 538 may also include attachment points. In one configuration, a sail banner may be attached to an attachment point of the top bracket 538 and an attachment point on one or more leg brackets 524. Additionally, or alternatively, the sail banner may be attached to other components of the shelter. The sail banner may be used to display information on the interior of the shelter 500. In one configuration, a roof material may be placed on the shelter 500. In this configuration, the roof structure is placed over the sail banner, such that only the roof structure is visible from the exterior of the shelter 500, while both the roof structure and the sail banner are visible from the interior of the shelter 500.

FIG. 5A illustrates an example of a sliding bracket 526 according to aspects of the present disclosure. As shown in FIG. 5A, a leg 508 passes through an opening of the sliding bracket 526. A pin 552 is used to engage the sliding bracket 526 with an opening in the leg 508 to keep the sliding bracket 526 in a desired position. The sliding bracket 526 includes one or more sockets 542 for engaging an end of a truss link, such as an outer truss link 552. A truss link may pivot within the socket 542. In one configuration, the sliding bracket 526 includes one or more attachment points of the multi-point attachment system.

Figure 5B:
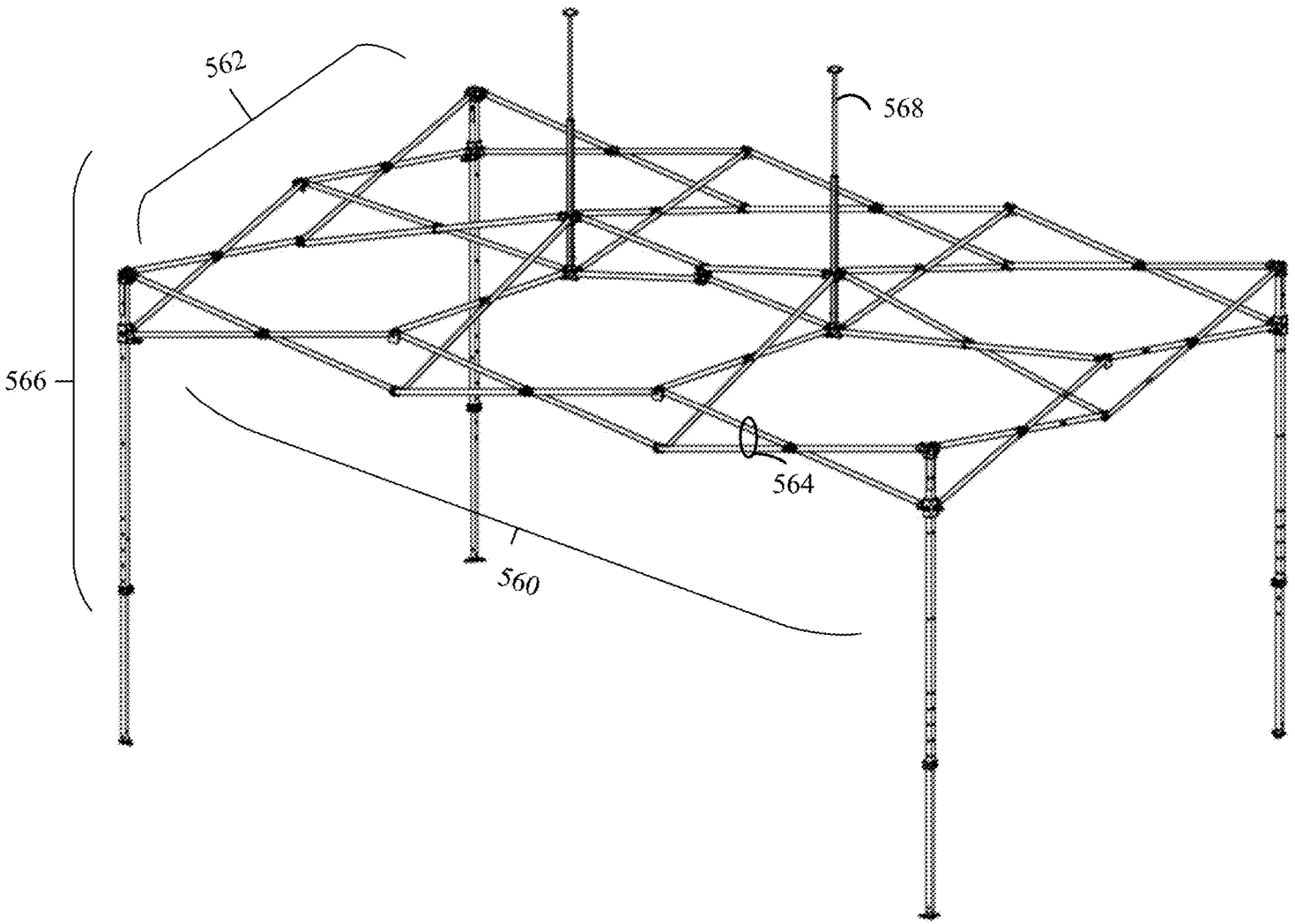

Aspects of the present disclosure are not limited to two outer truss link pairs per side. The number of outer truss link pairs, per side, may be less than or greater than two. For example, as shown in FIG. 5B, a first side 560 of a shelter 566 may include three outer truss link pairs 564 and a second side 562 may include two outer truss link pairs 564. In this example, the shelter 566 may include multiple peak beams 568. The other portions of the frame of the shelter 566 are similar to the frame of the shelter 500 of FIG. 5A. For brevity, the elements of the shelter 566 of FIG. 5B that are the same as the elements of the shelter 500 of FIG. 5A will not be discussed in detail.

Figure 6A:
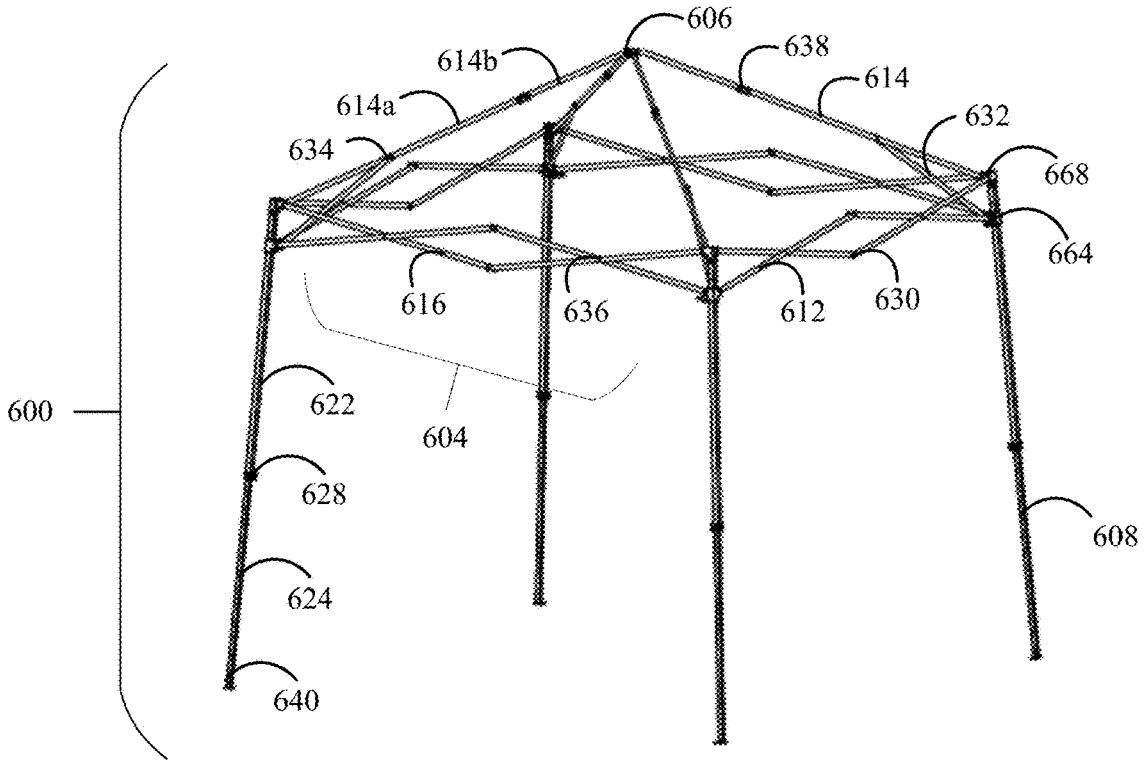

Aspects of the present disclosure are not limited to the shelters of FIGS. 5A and 5B as other types of shelters may be used for the multi-point attachment system. FIG. 6A illustrates an example of a frame for a shelter 600 with a peak shape roof in accordance with aspects of the present disclosure. The shelter 600 may be a modular folding shelter, such as a display booth. As shown in FIG. 6A, the shelter 600 has four sides 604 and four corners. Each side 604 may be substantially perpendicular to one or more adjacent sides 604. Of course, aspects of the present disclosure are not limited to a shelter 600 with four sides and four corners, as other configurations are also contemplated. The shelter 600 may be collapsible.

In one configuration, legs 608 are provided at each corner to erect the shelter 600. The legs 608 may be telescoping (e.g., extendable). That is, each leg 608 may comprise a telescoping lower section 624 that extends from a hollow upper section 622. The telescoping lower section 624 may be slidably disposed within the hollow upper section 622. A slider 628, such as a slider with a pull pin, may be used to extend the telescoping lower section 624 from the hollow upper section 622. Each telescoping lower section 624 has a foot 640 for engagement with the ground. Additionally, a perimeter truss framework 616 is connected to the legs 608 for stability and support.

The perimeter truss frame 616 may include multiple outer truss links 612. Two pivotally connected outer truss links 612 may form an outer truss link pair. The outer truss links 612 of each outer truss link pair may be pivotally connected to each other at a cross-link joint 636, such as in a scissor configuration. In one configuration, a first end of each outer truss link 612 is pivotally connected to a leg 608 via a sliding bracket 664 or a leg bracket 668. Specifically, the first end of one outer truss link 612 of each outer truss link pair may be pivotally connected to a socket of a sliding bracket 664. The first end of another outer truss link 612 of each outer truss link pair may be pivotally connected to a socket of the leg bracket 668, such that each outer truss link 612 is pivotally connected to a corresponding leg 608. The leg bracket 668 and/or the sliding bracket 664 may include one or more attachment points (see FIGS. 4A-B). A second end of each outer truss link 612 may be connected to a second end of another outer truss link 612 at an outer joint 630.

As shown in FIG. 6A, the frame may include multiple upper peak truss links 614 and lower peak truss links 632. A first end of each upper peak truss link 614 may be pivotally connected to a leg bracket 668. A second end of each upper peak truss link 614 may be pivotally connected to a peak center bracket 606. The center bracket 606 may include one or more attachment points of the multi-point attachment system. Each upper peak truss link 614 may also include a peak joint 638, such that a first portion 614*a* and a second portion 614*b* of each first peak truss link 614 are foldable. A first end of a lower peak truss link 632 may be pivotally connected to the upper peak truss link 614 at a truss joint 634. A second end of the lower peak truss link 632 may be pivotally connected to socket of a sliding bracket 664. Each socket of a sliding bracket 664 may include a handler for receiving a fastener.

The lower peak truss links 632 may provide support to a corresponding (e.g., adjacent) upper peak truss link 614. The upper peak truss links 614 form a peak for supporting a roof structure (not shown), such as a canopy. The lower peak truss links 632 and/or upper peak truss links 614 may be made of a rigid material or flexible material. The truss links may form a dome shape roof, a pyramid shape roof, or other type of roof.

Figure 6B:
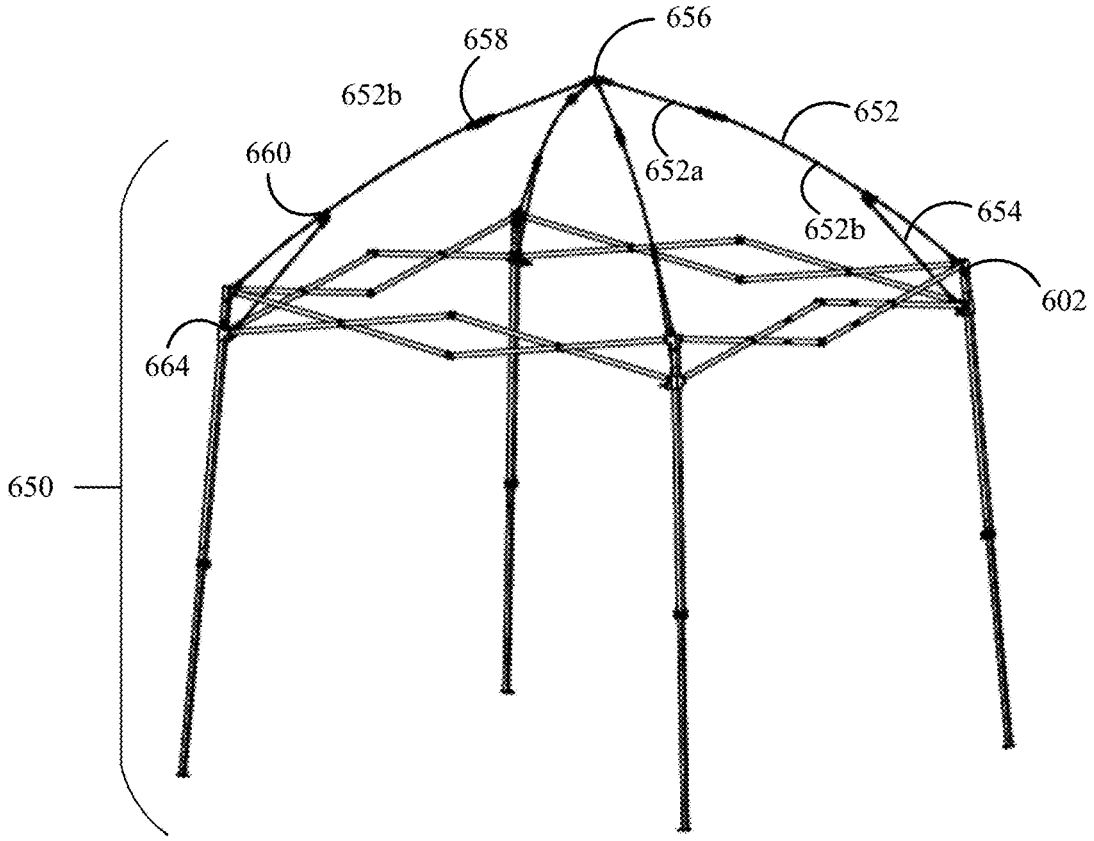

FIG. 6B illustrates an example of a frame of a shelter 650 with a dome shape roof according to aspects of the present disclosure. The frame of the shelter 650 is similar to the frame of the shelter 600 of FIG. 6A. For brevity, the elements of the shelter 650 of FIG. 6B that are the same as the elements of the shelter 600 of FIG. 6A will not be discussed in detail.

As shown in FIG. 6B, the frame may include multiple upper peak truss links 652 and lower peak truss links 654. A first end of each upper peak truss link 652 may be pivotally connected to a leg bracket 602. The leg bracket 602 may include a handle on each socket (see FIGS. 4A-4B). A second end of each upper peak truss link 652 may be pivotally connected to a dome center bracket 656. Each upper peak truss link 652 may also include a joint 658, such that a first portion 652*a* and a second portion 652*b* of each upper peak truss link 652 are foldable. A first end of a lower peak truss link 654 may be pivotally connected to the upper peak truss link 652 at a joint 660. A second end of the lower peak truss link 654 may be pivotally connected to a socket of a sliding bracket 664.

The lower peak truss links 654 may provide support to a corresponding (e.g., adjacent) upper peak truss link 652. The upper peak truss links 652 and lower peak truss links 654 form a dome for supporting a roof structure (not shown), such as a canopy. The lower peak truss links 654 and the upper peak truss links 652 may be a flexible material. For example, the lower peak truss links 654 and the upper peak truss links 652 may be flexible rods, such as composite fiber rods. The flexibility improves wind resistance.

As an example, a tent shelter, such as a cube tent, gazebo, or a structure with a roof, may be erected within the shelter 650. In one configuration, the tent shelter may have a cube shape and the sides of the tent shelter may be attached to attachment points on the leg brackets 602. Furthermore, a strap may be attached to the roof of the structure and an attachment point of the dome center bracket 656. The dome of the shelter 650 may then be covered with a roof fabric. The flexibility of the upper peak truss links 652 as well as the connection between the roof of the tent shelter and the dome of the shelter 650 improves the wind resistance of the structure. Aspects of the present disclosure are not limited to erecting a tent shelter in shelters with flexible peak truss links, as the tent shelter may be erected in any type of shelter with a multi-point attachment system.

Figure 7:
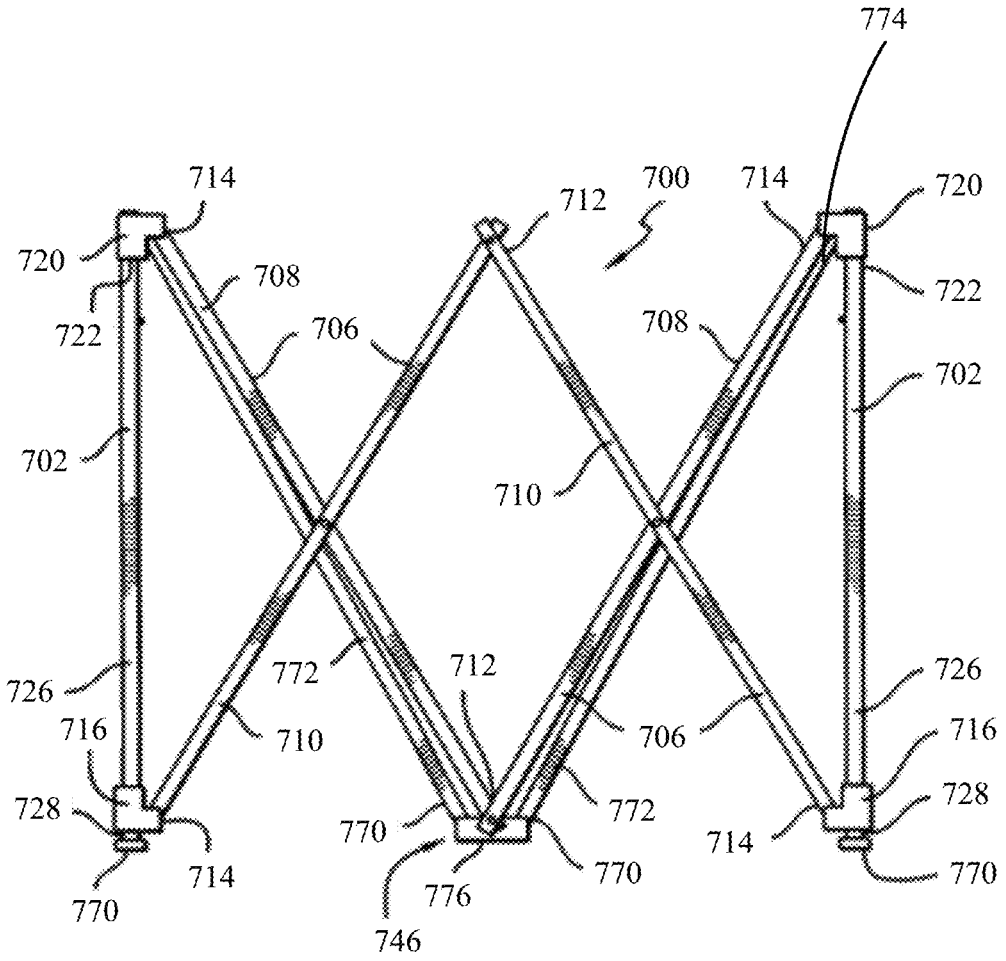

FIG. 7 illustrates an example of a shelter in a partially collapsed position. As shown in FIG. 7, a perimeter truss link assembly 700 having multiple perimeter truss pairs of link members 706 is connected to each leg 702. Each of the perimeter truss pairs including first link members 708 and second link members 710 that are pivotally connected together, such as in a scissors configuration. The first link member 708 and second link members 710 have inner ends 712 and outer ends 714. The outer end 714 of each first link member 708 connected to the upper end of one leg 702 via a leg bracket 720, and the outer end 714 of each second link member 710 being connected to a sliding leg bracket member 716 so as to be slidably connected to the leg 702. The inner ends 712 may be pivotally connected to each other. Each leg 702 may comprise a hollow upper section 726 and a telescoping lower section 728, with the lower section slidably disposed within the upper section, with the lower section having a foot section 770 for engagement with the ground. An end 722 of each leg 702 is connected to the leg bracket 720.

Figure 8:
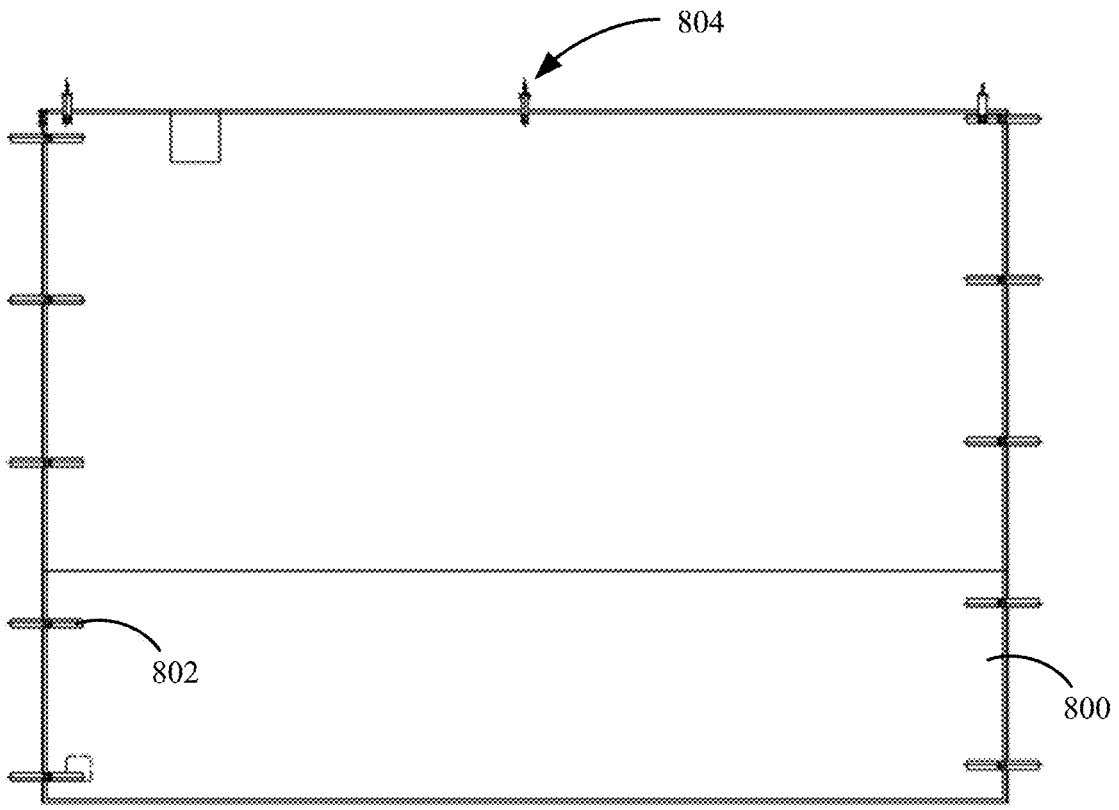
FIG. 8 illustrates an example of a sidewall according to aspects of the present disclosure.

FIG. 8 illustrates an example of a sidewall 800 according to an aspect of the present disclosure. As shown in FIG. 8, multiple straps 802 may be sewn (e.g., connected) to a material of a sidewall 800. Additionally, a fastener 804 may be connected to each strap 802. In one configuration, the fasteners 804 are connected to the straps 802 defined on a top portion of the sidewall. The fasteners 804 may be used to connect the sidewall 800 to a handle of a bracket. Aspects of the present disclosure are not limited to connecting the strap and fastener to a sidewall, the strap and fastener may also be connected to material of other structures, such as a tent, a flag, and an inner wall extending along the roof of the canopy, an information sheet, or any other type of structure or surface.

According to aspects of the present disclosure, information may be provided on a material that is to be attached to a portion of a collapsible shelter. In the present application, the material is also referred to as an information sheet, a banner, a sail banner, a textile banner, a textile sail, or a textile sheet. In one configuration, the material is attached to a peak beam, joints, legs, and/or other portions of the shelter. Furthermore, the material may be attached to handles of brackets. The brackets may be attached to the canopy peak assembly, joints, legs, and/or other portions of the shelter.

In one configuration, the sail is a quadrilateral with two adjacent edges of a first substantially similar length and two other adjacent edges of a second substantially similar length. The second length is different from the first length. Aspects of the present disclosure are not limited to two edges of a first length and two edges of a second length. Each edge may have a substantially similar or different length in comparison to a length of other edges. Furthermore, the sail is not limited to a quadrilateral, as other types of polygons are contemplated.

Figure 9A:
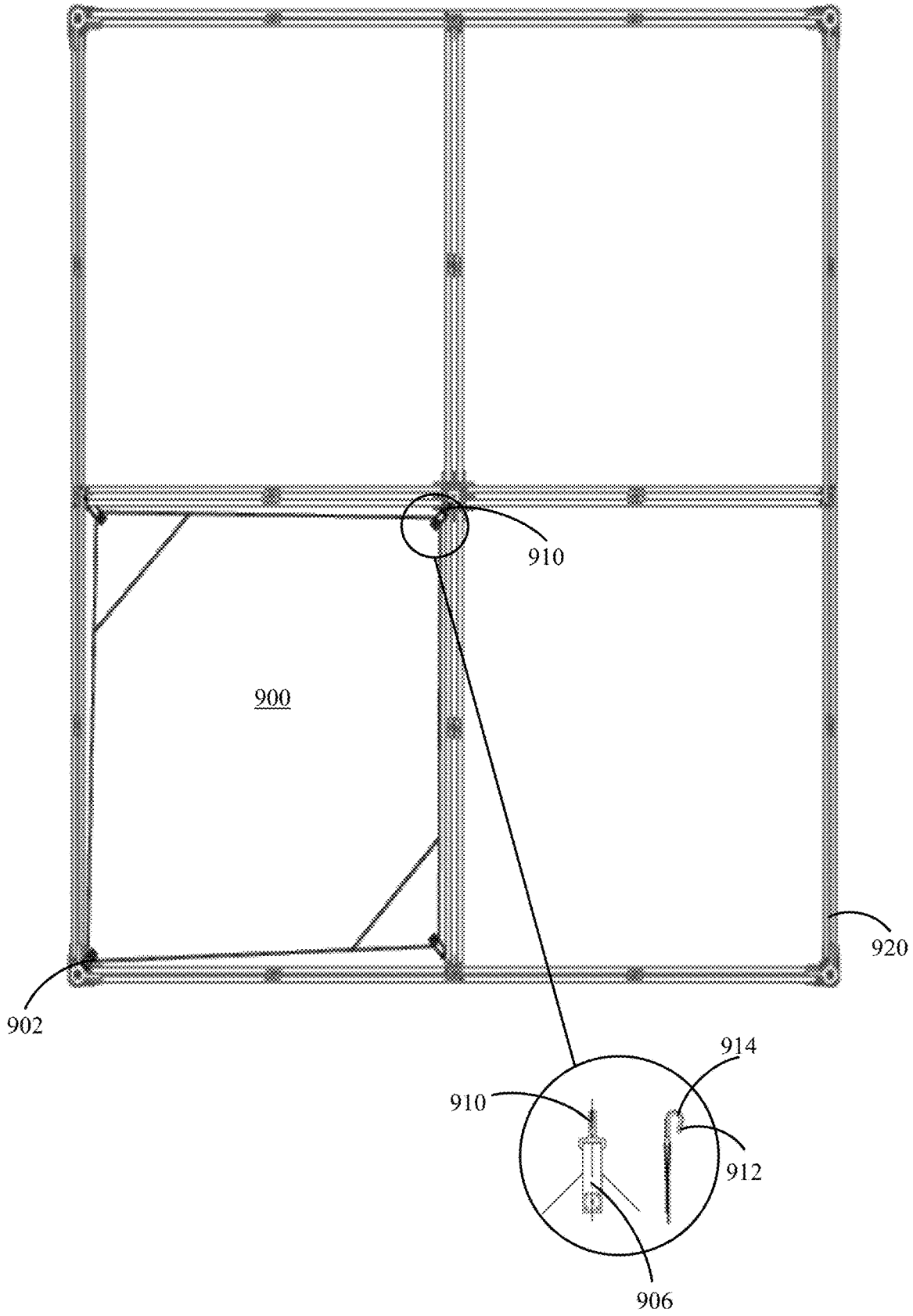
FIGS. 9A, 9B, 9C, 9D, and 9E illustrate examples of information sheets according to aspects of the present disclosure.

FIG. 9A illustrates an example of a sail 900 according to aspects of the present disclosure. Specifically, FIG. 9A illustrates a top-down view of a sail 900 attached to a shelter 920. As shown in FIG. 9A, the sail 900 has four corners 902 attached to the shelter 920. A fastener 910 may be attached to each corner 902. The fastener 910 may be similar to the fastener 300 of FIG. 3. That is, the fastener 910 may include an outward extending portion 912 at the bottom of a curved portion 914. The fastener 910 is adapted to clip to a handle of a bracket. A strap 906 of the fastener 910 may be sewn (e.g., connected) to each corner of the sail 900. Of course, other types of fasteners are also contemplated. The fasteners 910 may attach to various handles of the shelter 920.

Figure 9B:
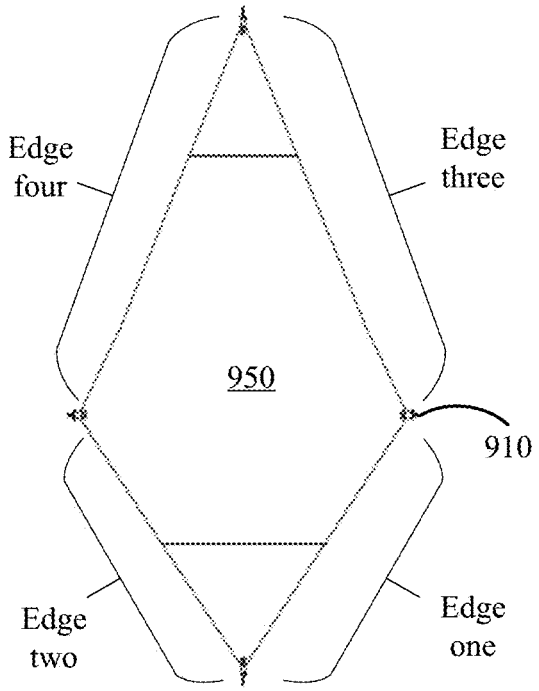

As shown in FIG. 9A, the sail includes four edges. Each edge may have the same length or different lengths. FIG. 9B illustrates an example of a sail 950 with a first edge and a second edge of a first length, and a third edge and a fourth edge of a second length. In one configuration, the first length is less than the second length. Furthermore, a first fastener 910 (e.g., strap 906) may be attached to a first corner 902 where the third edge and fourth edge meet. A second fastener 910 may be attached to a second corner where the first edge and the second edge meet. A third fastener 910 may be attached to a third corner where the third edge and the second edge meet. A fourth fastener 910 may be attached to a fourth corner where the first edge and the fourth edge meet. Each fastener 910 may be attached to a strap 906. Each strap 906 may be attached to a corner, or other portion, of the sail 950.

Figure 9C:
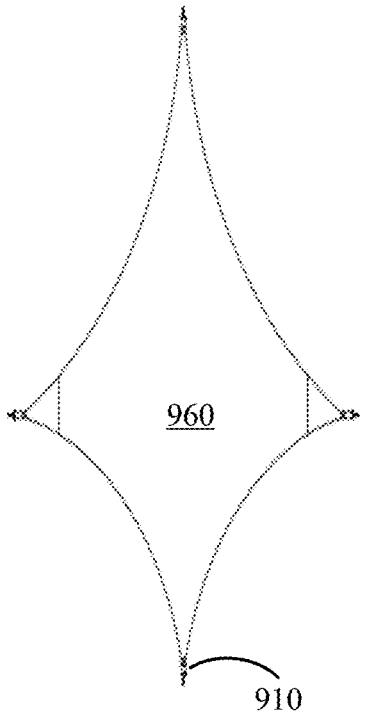
Figure 9D:
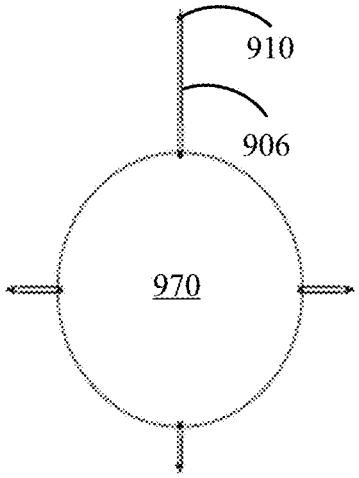
Figure 9E:
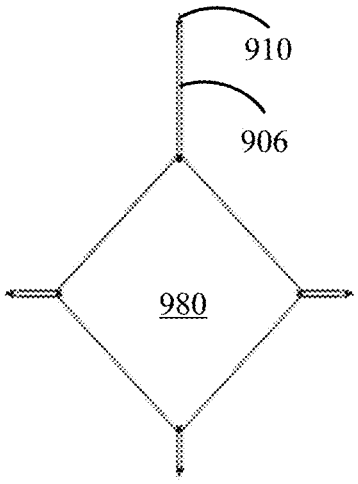

FIGS. 9C, 9D, and 9E illustrate other examples of sails 960, 970, 980. As shown in FIGS. 9A, 9B, 9C, 9D, and 9E, the sails 900, 950, 960, 970, 980 may be of different shapes and sizes. Each sail 900, 950, 960, 970, 980 has a fastener 910 attached to each corner. Aspects of the present disclosure are not limited to the fastener 910 being attached to a corner of a sail 900, 950, 960, 970, 980. The faster 910 may be attached to any location of the sail 900, 950, 960, 970, 980.

In one configuration, each fastener is attached to a handle of a shelter. The handles may be defined on a bracket or another component of the shelter. For example, one or more handles are defined on a top and/or bottom of a canopy pole for supporting a canopy. As another example, one or more handles are defined on a bracket connected to a leg of a frame. Additionally, or alternatively, one or more handles may be defined on links of a perimeter truss pair and/or at a joint where links of one or more perimeter truss pairs connect.

Figure 10A:
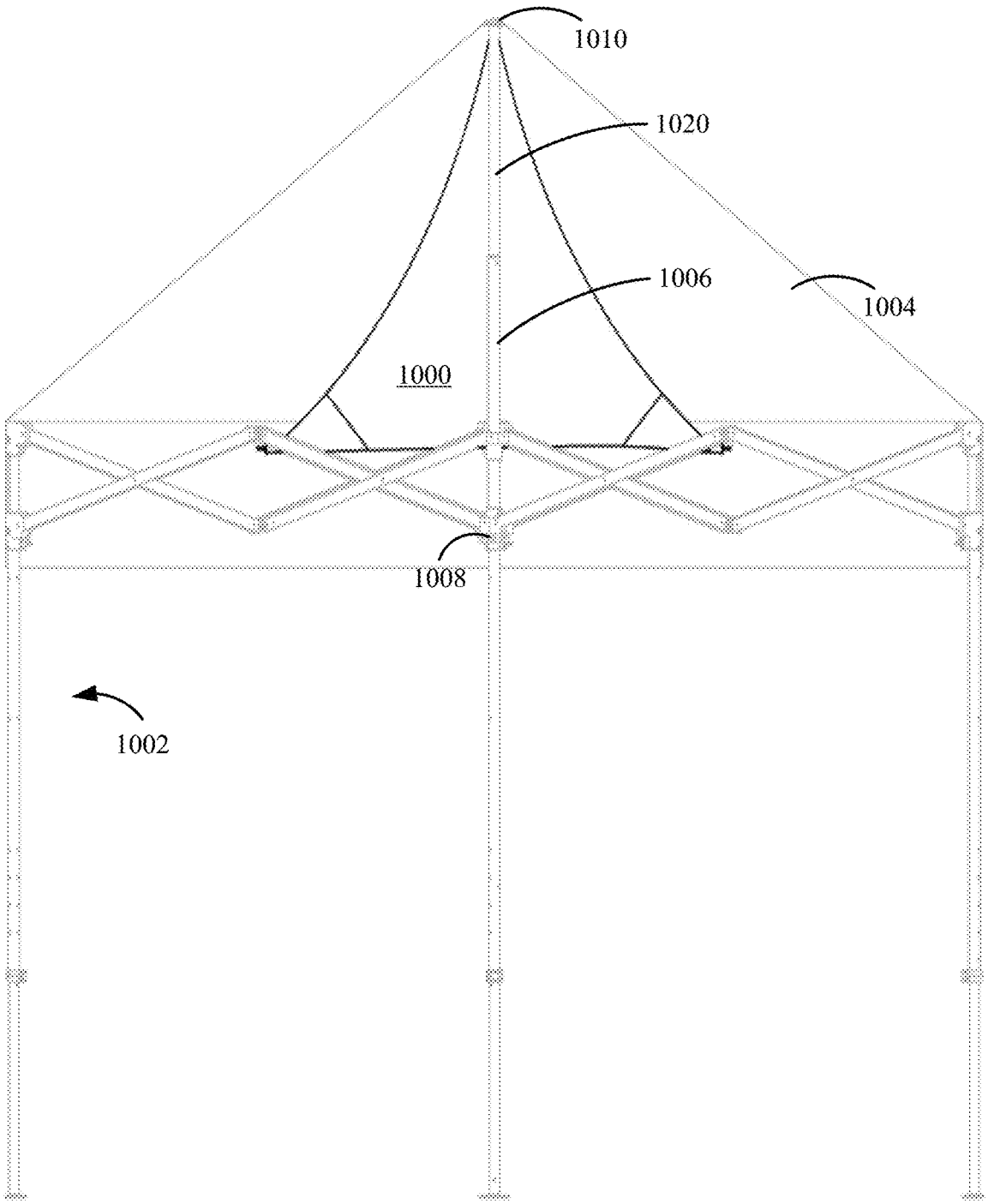
FIGS. 10A, 10B, 11, and 12 illustrate examples of information sheets attached to a shelter according to aspects of the present disclosure.

FIG. 10A illustrates an example of a cross section of an interior view of a sail 1000 attached to a shelter 1002 according to aspects of the present disclosure. As shown in FIG. 10A, a canopy 1004 covers an upper portion of the shelter 1002. In one configuration, the sail 1000 is positioned within an interior of the shelter 1002. Specifically, the sail 1000 is positioned at an upward facing angle and is beneath the canopy 1004. That is, the sail 1000 may be defined between the canopy 1004 and a link of an inner perimeter truss pair. A graphic may be printed on the sail 1000 to provide information and/or for aesthetic purposes.

According to aspects of the present disclosure, the canopy 1004 is elevated by peak beam 1006. A center bracket 1008 is attached to the bottom of the peak beam 1006 and a top bracket 1010 is attached to an upper portion of the peak beam 1006 (e.g., canopy pole). The top bracket 1010 may be attached to the end of the peak beam 1006 or another region of the peak beam 1006, such as a peak pole 1020 that extends from the peak beam 1006. The top bracket 1010 may be provided as support for the canopy 1004 as well as providing a location to attach another structure, such as the sail 1000. In one configuration, the top bracket 1010 is circular and perforated so that a hook or other connection can be attached to the top bracket 1010.

In one configuration, a first fastener of the sail 1000 is attached to the top bracket 1010. The first fastener may be attached via a hook or another type of attachment device. Additionally, a second fastener and a third fastener of the sail 1000 are attached to respective joints where a link of one outer perimeter truss pair and a link of another outer perimeter truss pair connect.

Figure 10B:
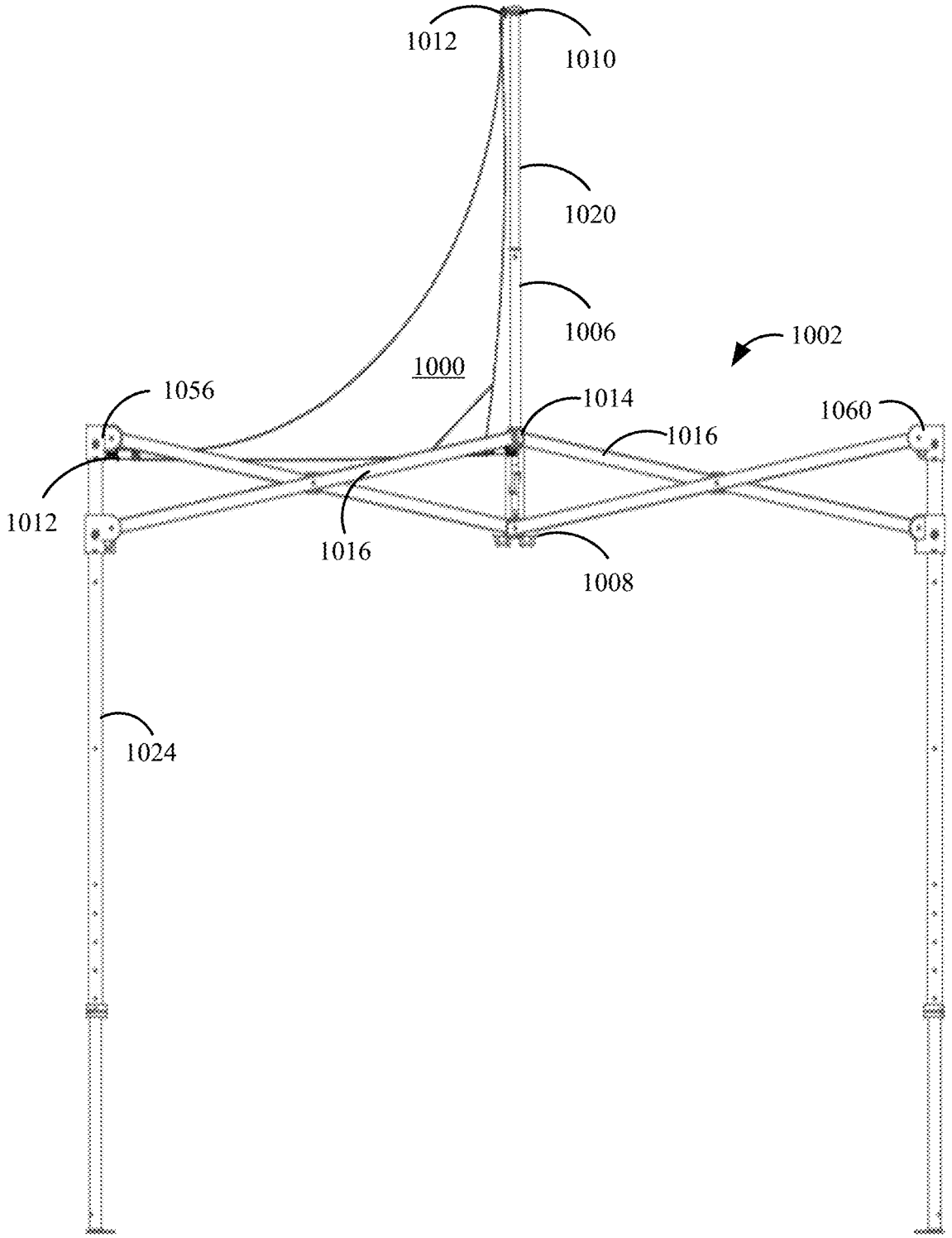

FIG. 10B illustrates an example of a side view of the sail 1000 attached to the shelter 1002 according to aspects of the present disclosure. A canopy (not shown) may cover an upper portion of the shelter 1002. In one configuration, the sail 1000 is positioned within an interior of the shelter 1002. As shown in FIG. 10B, a center bracket 1008 is attached to the bottom of the peak beam 1006 and a top bracket 1010 is attached to an upper portion of the peak beam 1006. The top bracket 1010 may be attached to the end of the peak beam 1006 or another region of the peak beam 1006, such as the peak pole 1020 that extends from the peak beam 1006. In one configuration, the sail 1000 is attached to different regions of the frame via fasteners. The fasteners may include hooks or another type of attaching structures. The fasteners may attach to handles or other types of receiving structures.

In one configuration, a first fastener 1012 of the sail 1000 is attached to the top bracket 1010. The first fastener 1012 may be a hook or another type of attachment device. Additionally, a second fastener 1012 and a third fastener 1012 of the sail 1000 are attached to respective joints 1014 where a link 1016 of a one outer perimeter truss pair and a link 1016 of another outer perimeter truss pair connect. Links of inner perimeter truss pairs are also attached to the joint 1014. The joint 1014 may include an eye or other structure for receiving the fastener 1012 of the sail 1000. Finally, a fourth fastener 1012 of the sail 1000 may be attached to a bracket 1056, which is attached to a leg 1024 of the shelter 1002. In another configuration (not shown in FIG. 10B), one or more fasteners 1012 of the sail 1000 are attached to the center bracket 1008.

In one configuration, a bracket 1056 is attached to the end of each leg 1024. The bracket 1056 may include two sockets 1060 for engaging with links 1016 (see also FIGS. 4A and 4B). Each link 1016 may be a link of an outer perimeter truss pair. The links 1016 may pivot within the socket. The number of sockets 1060 is not limited to two. Each bracket 1056 may include one or more sockets 1060. Furthermore, each bracket 1056 may include one or more handles for receiving an attaching structure, such as the fastener 1012. In one configuration, the fastener 1012 is attached to a strap of the sail 1000, such that one or more corners of the sail 1000 are engaged with a handle of a bracket 1056.

Aspects of the presented disclosure are not limited to attaching the sail to a shelter with a peak beam. The sail may be attached to other types of shelters, such as a dome roof, peak roof, pyramid roof, etc.

Figure 11:
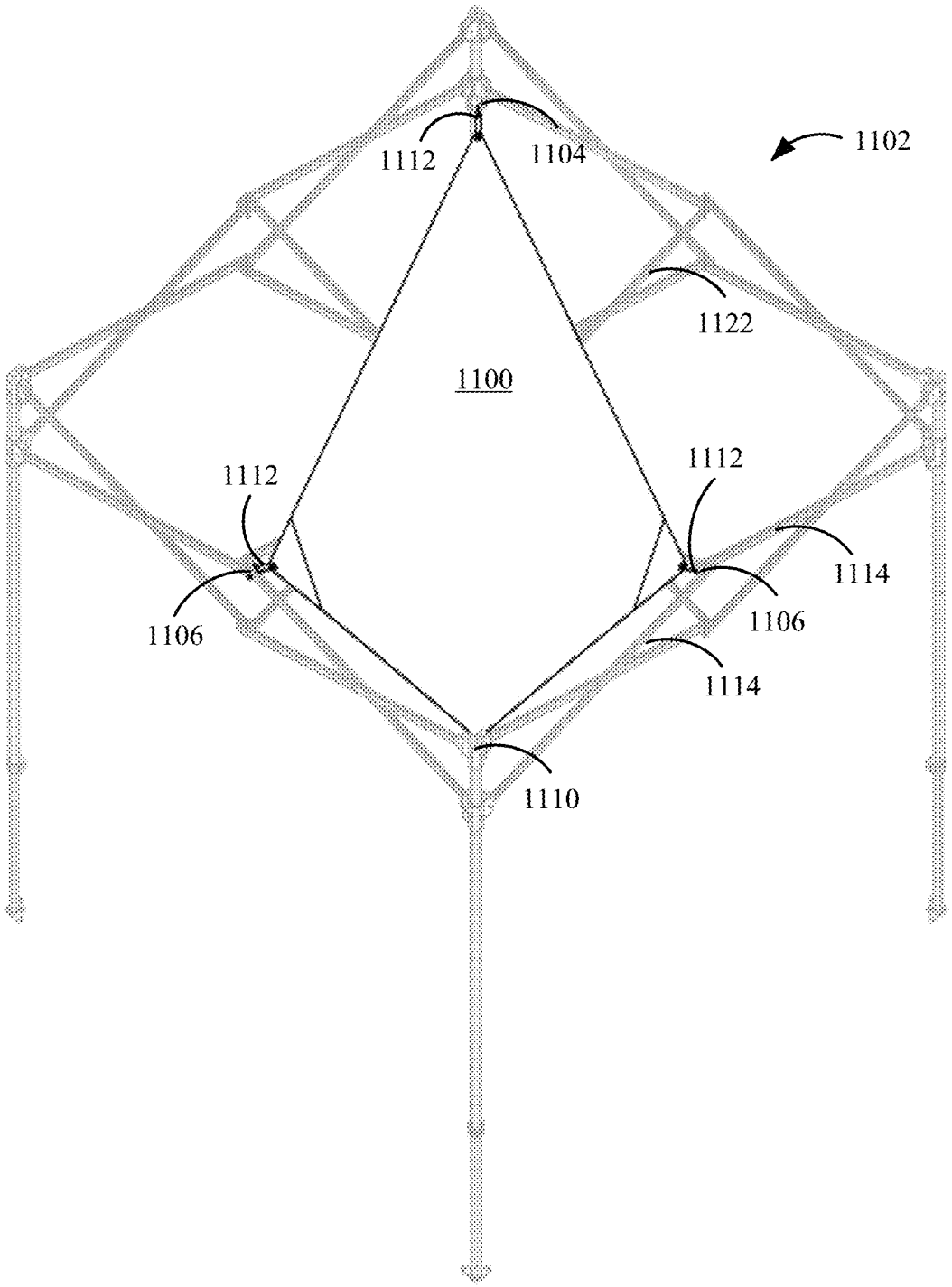

FIG. 11 illustrates an example of a perspective view of a sail 1100 attached to a shelter 1102 according to aspects of the present disclosure. As shown in FIG. 11, the sail 1100 may be attached to a leg bracket 1110, a peak center bracket 1104, and joints 1106 via one or more fasteners 1112. The leg bracket 1110, the top bracket 1104, and the joints 1106 may include one or more receiving structures, such as a handle or an eyelet, to engage with a fastener.

As shown in FIG. 11, a first fastener 1112 of the sail 1100 is attached to the top bracket 1104. The first fastener 1112 may be attached via a hook or another type of attachment device. Additionally, a second fastener 1112 and a third fastener 1112 of the sail 1100 are attached to respective joints 1106 where a link 1114 of one outer perimeter truss pair and a link 1114 of another outer perimeter truss pair connect. Additionally, a link 1122 of an inner perimeter truss pair is attached, to the joint 1106. The joint 1106 may include an eye or other structure for receiving the fastener 1112 (e.g., hook) from a strap connected to the sail 1100. Finally, a fourth fastener 1112 of the sail 1100 may be attached to a bracket attached to the leg bracket 1110. As all four corners of the sail 1100 are connected to the frame of the shelter 1102, the sail 1100 may be taut. Furthermore, the straps connected to each fastener 1112 may be adjustable (e.g., increase or decrease a length of a strap).

Additionally, aspects of the present disclosure are not limited to attaching only one sail to a structure. One or more sails may be attached to a structure as desired. Furthermore, a sail is not limited to covering a portion of an interior of the shelter. The sail may encompass a substantial portion of the upper region of an interior of the shelter to provide a layer between the shelter and the canopy. As an example, the sail may hide the portion of the canopy that is visible from an interior of the shelter. As another example, the sail may be placed on approximately ½ or ¾ of the interior of the shelter.

Figure 12:
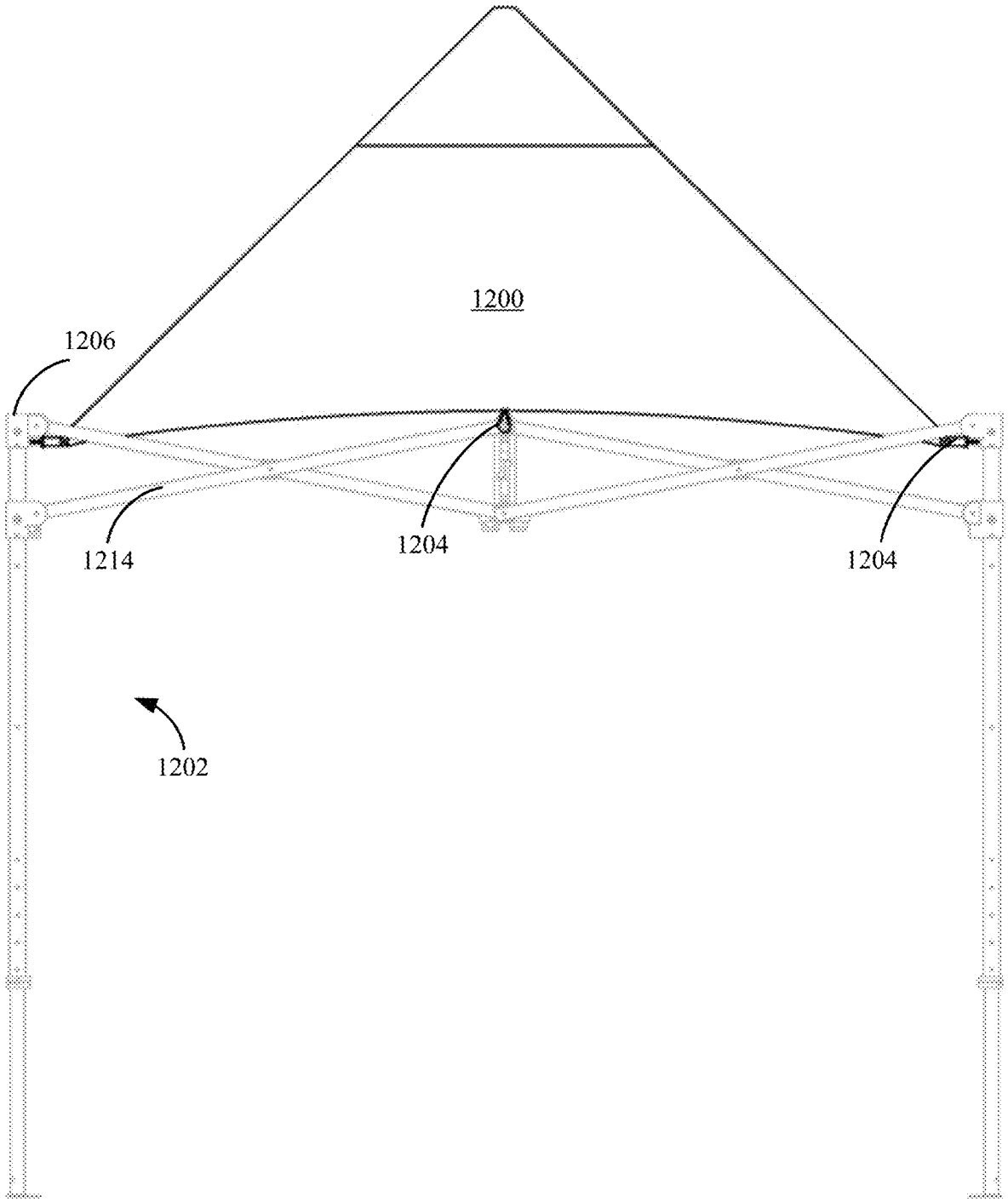

FIG. 12 illustrates an example of a sail 1200 encompassing an upper region of an interior of a shelter 1202 according to aspects of the present disclosure. Although not shown in FIG. 12, the sail 1200 may encompass an entire upper region or a partial upper region. In one configuration, a canopy (not shown) may be placed over the sail 1200. As shown in FIG. 12, each fastener 1204 of the sail 1200 may be attached to a leg bracket 1206, a joint, or a peak center bracket. The leg brackets 1206, the joints, and the peak center bracket may include one or more receiving structures, such as a handle or an eyelet, to engage with a fastener. In this example, the sail 1200 is between the interior truss links and a canopy (not shown). The fasteners 1204 may also be attached to truss links, such as interior truss links or outer truss links 1214.

According to aspects of the present disclosure, the sail 1200 is located beneath a canopy of the shelter 1202. That is, when the shelter 1202 is viewed externally, the canopy covers the sail 1200. When an upper portion (e.g., ceiling) of the shelter 1202 is viewed from within the shelter 1202, the sail 1200 is located beneath the canopy. As such, there may be space between the sail 1200 and the canopy. In one configuration, insulating material may be placed in the space between the sail 1200 and the canopy. The insulating material may provide insulation for a temperature within the shelter 1202, such that a temperature within the shelter 1202 is maintained regardless of an external temperature.

In another configuration, a temperature adjusting element, such as a fan or a heater, may be placed in the space between the sail 1200 and the canopy. The temperature adjusting element may be used to adjust the temperature within the shelter 1202. Additionally, by placing the temperature adjusting element in the aforementioned space, the temperature adjusting element would be hidden, or partially hidden, from occupants of the shelter, such that the shelter is aesthetically pleasing.

Figure 13:
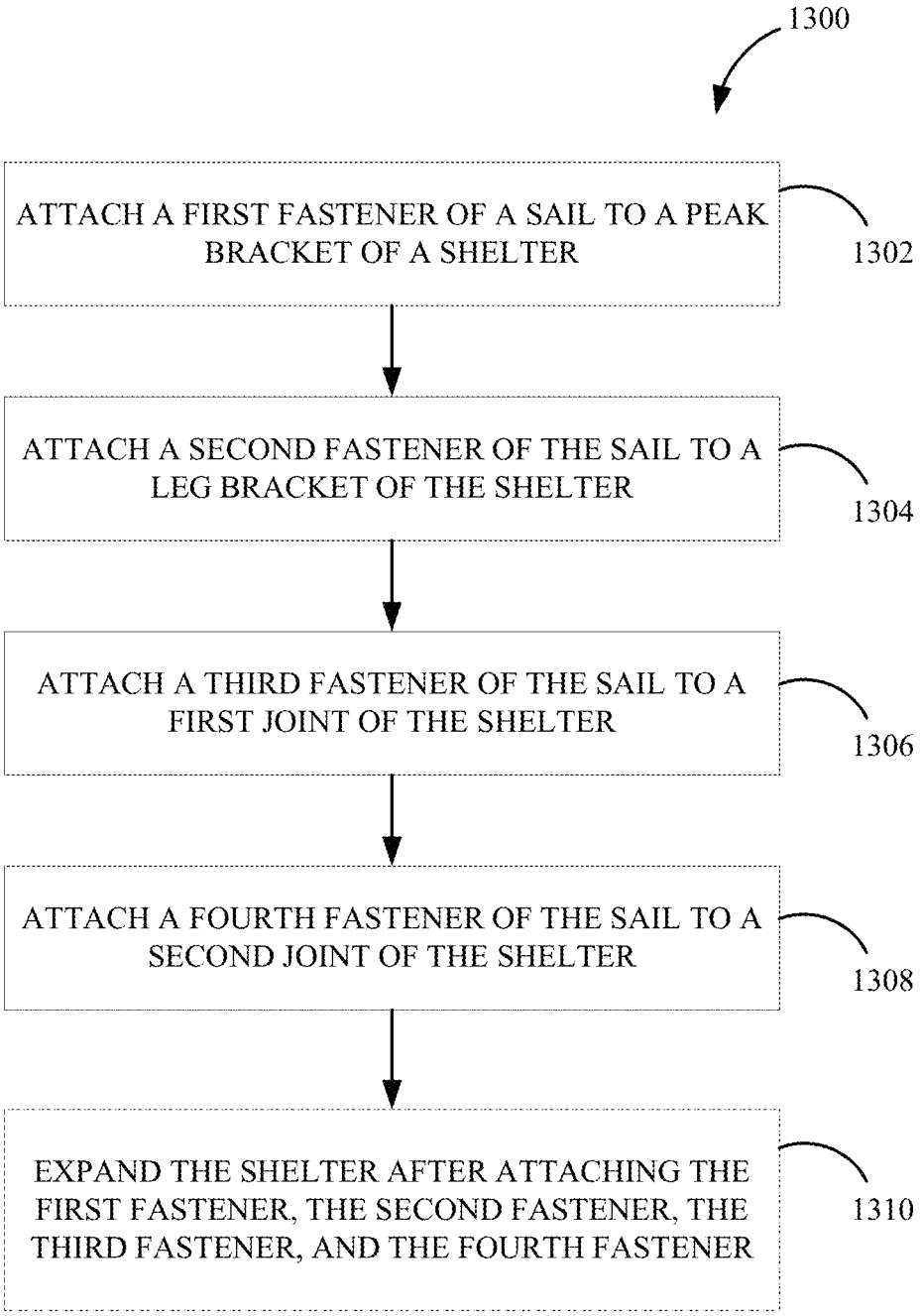
FIG. 13 illustrates a flow diagram for a method of providing information on an interior of a shelter via a sail according to aspects of the present disclosure.

According to aspects of the present disclosure, an information sheet may be attached during the process of unfolding and erecting a canopy or after the canopy has been erected. FIG. 13 illustrates a flow diagram 1300 for a method of providing information on the interior of a shelter via a sail (e.g., information sheet) according to aspects of the present disclosure. An image and/or text may be printed on the sail. At block 1302, a user attaches a first fastener of a sail to a peak bracket of a shelter. The peak bracket may be attached to an extendable peak pole that supports a canopy of the shelter. As previously discussed, the peak pole extends vertically from a peak beam. In another configuration, the peak bracket is supported by peak truss links.

At block 1304, the user attaches a second fastener of the sail to a leg bracket of the shelter. In one configuration, the leg bracket is attached to an extendable leg of the shelter. In another configuration, the leg bracket includes two or more sockets for pivotally engaging outer truss links. A first socket may engage a first outer truss link defined on a first side of the shelter and a second socket may engage a second outer truss link defined on a second side of the shelter. The first side and the second say may be adjacent.

At block 1306, the user attaches a third fastener of the sail to a first joint of the shelter. At block 1308, the user attaches a fourth fastener of the sail to a second joint of the shelter. In one configuration, the first joint connects the first outer truss link and a third outer truss link on the first side of the shelter. Additionally, the second joint may connect the second outer truss link and a fourth outer truss link on the second side of the shelter.

In an optional configuration, at block 1310, the user expands the shelter after attaching the first fastener, the second fastener, the third fastener, and the fourth fastener. That is, the shelter may be a collapsible shelter. The sail may be attached to the shelter while the shelter is collapsed. Alternatively, the sail may be attached at any time while expanding the canopy. Additionally, the sail is located below a canopy (e.g., roof) of the shelter. The canopy may be placed over the sail while the shelter is collapsed. In another configuration, the canopy is first attached and then the sail is attached.

The sail may include four edges. A first edge and a second edge may have a first length. A third edge and a fourth edge may have a second length. In one configuration, the first length is less than the second length. Furthermore, the first fastener may be defined at a first corner where the third edge and fourth edge meet. The second fastener may be defined at a second corner where the first edge and the second edge meet. The third fastener may be defined at a third corner where the third edge and the second edge meet. The fourth fastener may be defined at a fourth corner where the first edge and the fourth edge meet. Each fastener may be attached to a strap. Each strap may be attached to a respective corner, or other portion, of the sail.

The method of providing information on the interior of a shelter via a sail is not limited to the order provided in FIG. 13. The fasteners (e.g., first, second, third, and fourth fasteners) may be attached in any order. Furthermore, one or more fasteners may be attached while the shelter is collapsed while other fasteners are attached when the shelter is expanded (e.g., erect).

As used herein, a phrase referring to "at least one of" a list of items refers to any combination of those items, including single members. As an example, "at least one of: a, b, or c" is intended to cover: a, b, c, a-b, a-c, b-c, and a-b-c.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes, and variations may be made in the arrangement, operation and details of the methods and apparatus described above without departing from the scope of the claims.

What is claimed is:

1. A sail in combination with a shelter, the shelter comprising:

a bracket comprising:

a socket for receiving an end of a link member of a perimeter truss of a roof structure of the shelter, and a handle for receiving a fastener, a first end of the handle attached to the socket and a second end of the handle attached to the bracket;

a plurality of legs for supporting the roof structure, the bracket coupled to one of the plurality of legs; and a peak bracket supported by an inner truss of the shelter, the peak bracket supporting a canopy of the shelter; and the sail comprising:

a first fastener configured to fasten to the peak bracket;

a second fastener configured to fasten to the handle of the bracket;

a third fastener configured to fasten to a first portion of a the perimeter truss on a first side of the shelter; and a fourth fastener configured to fasten to a second portion of the perimeter truss on a second side of the shelter.

2. The combination of claim 1, in which the sail comprises four edges, a first edge and a second edge having a first length and a third edge and a fourth edge having a second length.

3. The combination of claim 2, in which the first length is less than the second length.

4. The combination of claim 1, in which the peak bracket is attached to an extendable peak pole that supports the canopy of the shelter.

5. The combination of claim 1, in which each one of the plurality of legs is extendable.

6. The combination of claim 1, in which the bracket comprises at least two sockets.

7. The combination of claim 6, in which:

the first portion comprises a first joint connected to a first perimeter truss link and a third perimeter truss link on the first side of the shelter; and the second portion comprises a second joint connected to a second perimeter truss link and a fourth perimeter truss link on the second side of the shelter.

8. The combination of claim 7, in which the second side is adjacent to the first side.

9. The combination of claim 1, in which the sail is positioned below the canopy of the shelter.

10. The combination of claim 1, in which the sail comprises a printed image.

11. A method of providing information on an interior of a shelter via a sail, comprising:

attaching a first fastener of the sail to a peak bracket of the shelter;

attaching a second fastener of the sail to a leg bracket of the shelter;

attaching a third fastener of the sail to a first joint of the shelter; and attaching a fourth fastener of the sail to a second joint of the shelter, the sail comprising at least an image, text, or a combination thereof.

12. The method of claim 11, in which the sail comprises four edges, a first edge and a second edge having a first length and a third edge and a fourth edge having a second length.

13. The method of claim 12, in which the first length is less than the second length.

14. The method of claim 11, in which the peak bracket is attached to an extendable peak pole that supports a canopy of the shelter.

15. The method of claim 11, in which the leg bracket is attached to an extendable leg of the shelter.

16. The method of claim 11, in which the leg bracket comprises at least two sockets, a first socket engaging a first outer truss link defined on a first side of the shelter and a second socket engaging a second outer truss link defined on a second side of the shelter.

17. The method of claim 16, in which:

the first joint connects the first outer truss link and a third outer truss link on the first side of the shelter; and the second joint connects the second outer truss link and a fourth outer truss link on the second side of the shelter.

18. The method of claim 17, in which the second side is adjacent to the first side.

19. The method of claim 11, in which the sail is positioned below a canopy of the shelter.

20. The method of claim 11, further comprising expanding the shelter after attaching the first fastener, the second fastener, the third fastener, and the fourth fastener.

* * * * *